US012030592B2

(12) United States Patent
Denny et al.

(10) Patent No.: US 12,030,592 B2
(45) Date of Patent: Jul. 9, 2024

(54) ACCESSORY SUPPORT SYSTEM FOR A PONTOON BOAT

(71) Applicant: CherSea, LLC, Sarasota, FL (US)

(72) Inventors: Cheryl Denny, Fenton, MI (US); Mark Denny, Fenton, MI (US)

(73) Assignee: CherSea, LLC, Sarasota, FL (US)

( * ) Notice: Subject to any disclaimer, the term of this patent is extended or adjusted under 35 U.S.C. 154(b) by 586 days.

(21) Appl. No.: 17/353,610

(22) Filed: Jun. 21, 2021

(65) Prior Publication Data

US 2022/0402579 A1 Dec. 22, 2022

(51) Int. Cl.
*B63B 25/28* (2006.01)
*B63B 35/34* (2006.01)

(52) U.S. Cl.
CPC ..... *B63B 25/28* (2013.01); *B63B 35/34* (2013.01)

(58) Field of Classification Search
CPC ..... B63B 25/28; B63B 35/34
See application file for complete search history.

(56) References Cited

U.S. PATENT DOCUMENTS 5,085,164 A * 2/1992 Whitton ..... B63B 27/14 114/362
5,423,650 A 6/1995 Zerbst et al.
5,887,540 A * 3/1999 Krish, Jr. ..... B63B 27/14 114/362
6,058,875 A * 5/2000 Krish, Jr. ..... E06C 5/02 114/362
6,869,092 B1 3/2005 Henn
6,925,955 B1 * 8/2005 Brooks ..... B63B 34/05 114/345
7,255,057 B2 8/2007 Wright
8,056,496 B1 * 11/2011 Bussa ..... B63B 27/146 114/362
8,720,643 B1 * 5/2014 Adair ..... B63B 27/146 182/95
9,302,740 B2 * 4/2016 O'Neal ..... B63B 35/613
9,334,021 B1 * 5/2016 Fielding ..... B63B 35/607
9,334,023 B2 * 5/2016 Admire ..... B63B 29/00
9,586,655 B1 * 3/2017 Butler ..... B63B 17/00
9,994,141 B1 6/2018 Hanser et al.
10,017,235 B2 * 7/2018 Pappas ..... B63H 20/02
10,913,513 B2 * 2/2021 Lashmann ..... B63B 27/16
11,155,323 B2 * 10/2021 Fournier ..... B63B 17/00
2007/0074647 A1 * 4/2007 Moore ..... B63B 35/34 114/266

(Continued)

*Primary Examiner* — S. Joseph Morano
*Assistant Examiner* — Jovon E Hayes
(74) *Attorney, Agent, or Firm* — Finch & Maloney PLLC

(57) ABSTRACT

An accessory system for a pontoon boat includes a support comprising longitudinal members and at least one support crosspiece connected between the longitudinal members, where the support can be attached to a structural component of a pontoon boat and move between a stowed position and a deployed position. An accessory component includes one or more hangers with a hook constructed to engage the support. A support portion is connected to the accessory component and extends transversely away from the one or more hangers. In use, the support can be deployed along a side of a pontoon with the accessory component removably attached to the support. The accessory component can be used to support a platform, a grill, a cooler or other accessory alongside the pontoon boat.

20 Claims, 8 Drawing Sheets

(56) References Cited

U.S. PATENT DOCUMENTS

| | | | | |
|---|---|---|---|---|
| 2010/0230210 | A1* | 9/2010 | Hanks | B60P 3/08<br>182/113 |
| 2021/0047001 | A1* | 2/2021 | Thomas | B63B 3/48 |

* cited by examiner

ACCESSORY SUPPORT SYSTEM FOR A PONTOON BOAT

TECHNICAL FIELD

The present disclosure relates generally to accessories for boats and other vehicles. More specifically, the present disclosure relates to an accessory support system that can be used on a pontoon boat to provide easy access to the accessory from outside the boat.

BACKGROUND

Pontoon boats include a pair of spaced apart pontoons extending longitudinally along the length of the boat. In some cases, a third pontoon extends longitudinally down the center of the boat between the first and second pontoons (sometimes referred to as a "tritoon"). Crossmembers extend laterally and are secured to the top of the pontoons. The crossmembers are distributed along the length of the boat, typically with 16" spacing along a majority of the boat, where the crossmembers form the support structure for the boat's deck. The pontoons and crossmembers are usually made of aluminum and the crossmembers can have an I-shape, a rectangular C-shape, a W-shape, or be a hollow tube of square or rectangular shape, for example. Marine grade decking is attached to the crossmembers to form the deck. Carpet, furniture, rails, and finishes are secured to the deck. Pontoon boats are commonly sized from about 20 feet to 30 feet in length along with some shorter and longer variants. Pontoon boats in this length typically have an overall width of about eight feet and pontoon diameters of 20-26 inches.

SUMMARY

One aspect of the present disclosure is directed to an accessory support system that comprises a support, an accessory component, and a support portion. For example, the support has longitudinal members and at least one support crosspiece connected between and extending crosswise to the longitudinal members. In one embodiment, the support includes a pair of longitudinal members and two or more support crosspieces. The support is configured to be attached to a structural component of a pontoon boat, such as the deck or structural crosspieces below the deck. In a deployed position of one embodiment, the support extends vertically down along a side of a pontoon of the pontoon boat. In another embodiment, the support extends laterally outward from the deck in the deployed position. The accessory component is configured to be removably attached to the support and includes one or more attachment features constructed to engage the support. In one example, the attachment feature includes a hook. In other embodiments, the attachment feature can be a bracket, a horizontal bar overlapping the support, or a post received in an opening on the support, for example. In some examples, the support portion comprises a seat, a platform, or a frame useful to support an accessory. When installed, the accessory component can be used externally to the boat, RV, or truck as a chair or as part of a platform, a grill, a cooler, or other accessory. In one example, a portable grill has brackets and the support portion has a frame constructed to engage the brackets on the portable grill to support the portable grill, which can be accessed from outside a pontoon boat in the water.

In some embodiments, the first end of the support is movably connected to a track. The track is configured to be secured to a deck or to a structural crosspiece of a pontoon boat. For example, the structural component of the pontoon boat is a structural crosspiece of a boat deck or the deck itself. When installed on the pontoon boat, the first end of the support is movable along the track to move the support between a stowed position and a deployed position. In one example, the track is a roller track, and the first end of the support comprises a roller movably received in the roller track. In another example, the first end of the support glides or slides along the track.

In some embodiments, the system includes a retaining device on the accessory component. The retaining device is configured to be operable between a released position and a retaining position such that in the retaining position the retaining device secures the accessory component to the support by obstructing or otherwise preventing removal of the attachment or hook from the support crosspiece or support arm. For example, the retaining device is a spring-loaded gate on the hook, a strap, a cord, a chain, a catch, a latch, or a spring plunger.

In some embodiments, the support crosspiece has an adjustable position along the longitudinal members of the support. In such embodiments, the vertical position of the accessory (e.g., a grill or platform) can be adjusted to be at, above, or below water level as desired. Stated differently, the support portion of the accessory component is configured to have a vertical position at or above a center of a pontoon of the pontoon boat when the accessory is installed on the support.

Also disclosed is a method of using an accessory support system. In accordance with one embodiment, the method includes providing a pontoon boat that includes pontoons, a deck over the pontoons, structural crosspieces between the deck and the pontoons, and an accessory support secured to a structural component of the pontoon boat. The accessory support includes one or more longitudinal members and may include one or more support crosspieces connected to and extending crosswise to the one or more longitudinal members. The accessory support is movable between a stowed position and a deployed position. The method also includes deploying the support from a stowed position in which the support is oriented horizontally above or below the deck, to a deployed position. In one embodiment, the support is oriented vertically with a first end of the support connected to the structural component and a second end of the accessory support vertically below the first end, wherein a portion of the accessory support extends along a side of one of the pontoons. In another embodiment, the support extends horizontally outward beyond the deck when the support is in the deployed position. The method further includes attaching an accessory component to the support.

In some embodiments, the method includes placing an accessory on the accessory component. For example, the accessory is selected from a portable grill, a cooler, or a seat, where at least part of the accessory has a vertical position at or above a center of the side of one of the pontoons.

In some embodiments, the accessory component comprises a platform generally extending in a horizontal plane when the accessory component is attached to the accessory support.

In some embodiments, the support is oriented horizontally between adjacent structural crosspieces below the deck when in the stowed position. In other embodiments, the accessory support is oriented horizontally along a top of the deck when in the stowed position. In yet other embodiments, the support is oriented vertically against a railing of the pontoon boat with the second end of the support above the first end of the support.

Some embodiments of the method include securing a track to a top surface of the deck, where the first end of the support is connected to and movable along the track or slide. In other embodiments, the method includes securing a track or slide to adjacent structural crosspieces of the pontoon boat, where the first end of the support is connected to and movable along the track or slide below the deck.

In some embodiments, deploying the accessory support includes folding the accessory support downward against the pontoon.

Some embodiments of the method include locking the accessory component to the accessory support using one of a spring-loaded gate, a catch, a tether, or a bracket.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
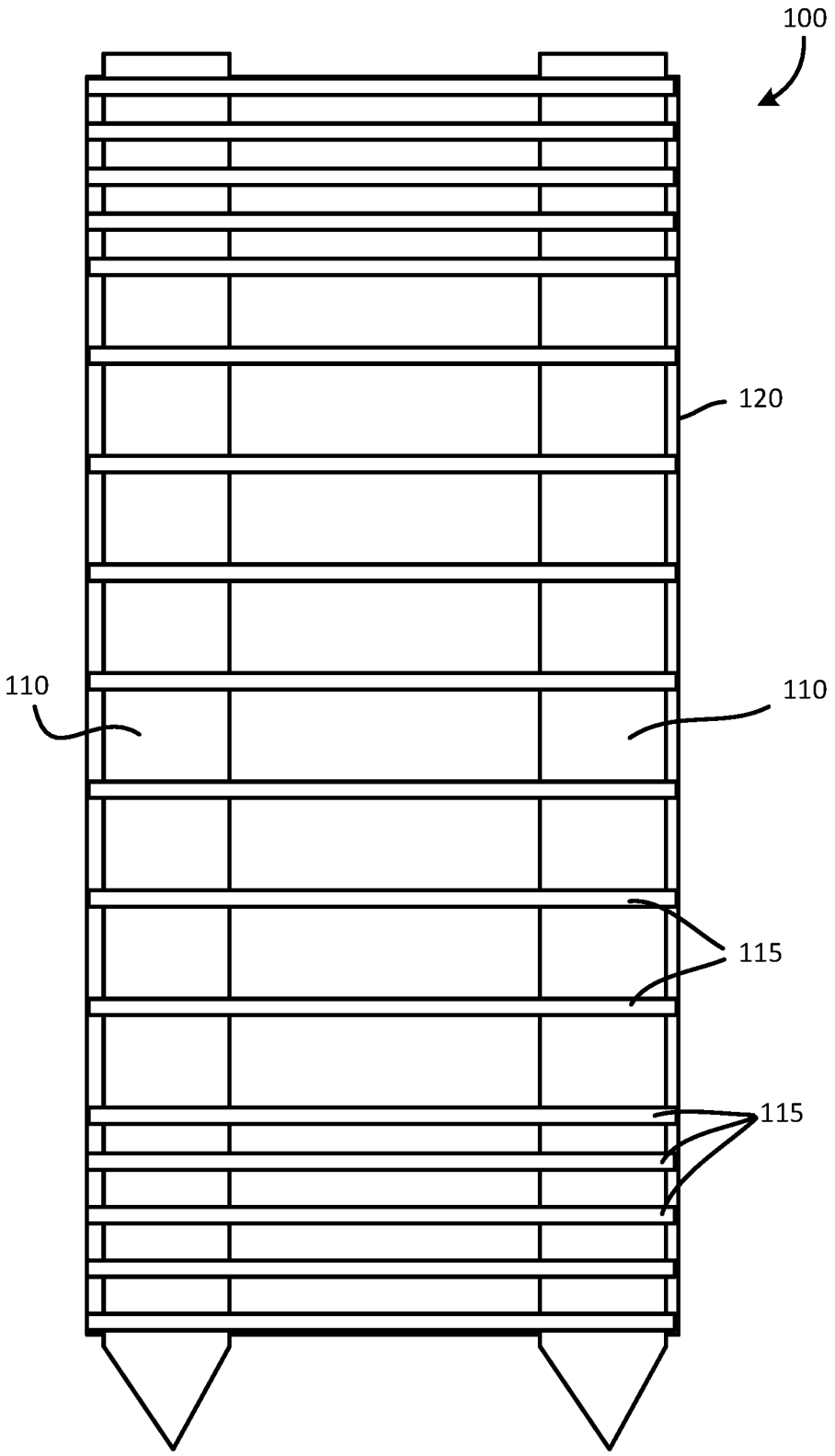
FIG. 1 is a top plan view of structural components of a typical pontoon boat that includes pontoons, structural crosspieces, and a deck, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is an accessory support system for a pontoon boat and method of use. In accordance with one embodiment, the support system includes a support attached to structural components of the boat, such as the top of the deck or to structural crosspieces below the deck. The support is movable between a stowed position and a deployed position. For example, the support is stowed in a horizontal position beneath the deck between adjacent structural crosspieces of the boat. The support can be deployed by sliding or rolling the support along tracks or slides secured to the boat. In the deployed position, for example, the support extends down from the boat's deck with part of the support member adjacent or in contact with the side of a pontoon when used on the side of the pontoon boat. An accessory component can be removably attached to the support crosspiece(s). For example, the accessory component includes hangers each having a hook that is configured to engage the supports and/or support crosspieces. A support portion is connected to the accessory component and extends transversely away from the hangers. The support portion may comprise a bracket, a frame, a seat, a shelf, a platform, or a walkway that generally extends in a horizontal plane when the accessory component is attached to the support. An accessory, such as a grill, chair, or cooler, can be placed on the support portion and retained at water level or other desired vertical position alongside the pontoon.

GENERAL OVERVIEW

Pontoon boats are appealing to boaters for their planar deck structure that accommodates comfortable seating, a great view of the water, and a generally higher capacity of occupants compared to similarly sized V-hull boats. For this reason, pontoon boats have become a favorite for recreation and social situations on the water. It is common for a group of pontoon boats to anchor near a sandbar or other region of shallow water where the boaters can associate with each other and play in the water. In such instances, the boat is conveniently positioned nearby with supplies, food, and refreshments. The boat also functions as a place where boaters can get out of the water and take cover from the sun.

During such social boating situations, people often want to be both in the water and enjoy the convenience of the boat's deck. Accessories placed in the water tend to move separately from the boat due to waves. Accordingly, coolers, grills, and other accessories need to be stored on the boat to prevent them from floating away and to prevent them from being bumped by the boat shifting in the water. For the same reason, pets, food, and refreshments, and toys are also usually stored on or away from the boat. Unfortunately, the height of the boat's deck above the water combined with the depth of the water requires climbing up and down between the water and the boat deck to access these amenities. Similarly, storing amenities away from the boat results is inconvenient. A variety of situations require boaters to repeatedly go back and forth between the water and the boat's deck or to wade through the water to retrieve amenities stored away from the boat.

It would be desirable to have a way to attach accessories to the outside of a pontoon boat so that the items remain attached to the boat and those items are located at or near water level for easy access to people in the water. It would also be desirable for the system to provide a place for boaters to sit and relax in the water without having to stand for long periods of time. Further, it would be desirable to have a support system that is retractable so it can be deployed for use when desired, and then folded, retracted, or otherwise put away when the boat is in motion.

The present disclosure addresses this need and others by providing an accessory support system that can be used with pontoon boats. In similar fashion, an accessory support system as variously described herein can be used with recreational vehicles, trailers, trucks, and other types of boats. Accordingly, a variety of vehicles can benefit from an accessory support system that enables amenities or accessories to be accessed from the outside of the vehicle. In accordance with one embodiment, the support system includes a retractable support structure that is mounted to structural members of the pontoon boat, such as the crosspieces beneath the deck. In one such embodiment, the support structure can be stored in a space between the pontoons and the deck and deployed by sliding the support structure out of the space and folding it down along the side of the pontoon. In another embodiment, the support structure connects to the boat deck, where the support structure folds up along the railing when not in use and folds down against the side of the pontoon when in use.

One support includes a pair of longitudinal members (e.g., tubes) connected by crosspieces, where the longitudinal members have an upright orientation that extends down to water level or below when the support is deployed. An accessory component can be removably attached to the support. In some embodiments, the support has two crosspieces; in other embodiments, the support has more or fewer crosspieces, such as a single crosspiece or 4 to 6 crosspieces, to enable a variety of different positions for attaching an accessory component. The accessory component includes hangers with hooks configured to engage crosspieces of the support. Thus, the vertical position of the accessory component can be adjusted to be below, at, or above water level by attaching the hooks, or other attachment method, to the desired support crosspieces. Alternately, the vertical position of the support crosspieces can be adjusted as needed by loosening a cylindrical clamp connecting the tubes and crosspieces of the support, and in turn adjusting the vertical position of the accessory component. After hanging the accessory component on the support, a strap or other retaining device can be used to secure the accessory to the support. A grill, cooler, seat, platform or other accessory can be placed on the accessory component, whether at water level, partially in the water, or above water. Numerous variations and embodiments will be apparent in light of the present disclosure.

EXAMPLE EMBODIMENTS

FIG. 1 illustrates a top plan view showing structural components of a pontoon boat 100, in accordance with an embodiment of the present disclosure. The boat 100 includes a pair of pontoons 110 extending in a spaced-apart, longitudinal arrangement along the length of the boat 100. Crosspieces 115 are attached to the top of each pontoon 110 and extend laterally across the boat 100. The structural crosspieces 115 (or simply "crosspieces" 115) may be spaced 16 inches on center along a middle portion of the boat 100, and optionally can have tighter spacing along the bow and stern of the boat 100 as shown. Decking material, such as marine-grade plywood, can be attached to the crosspieces 115 to define the deck 120 that supports the seating, control station, railing, and the like. Each pontoon 110 may be flush with or inset from the adjacent lateral side of the deck 120.

Figure 2A:
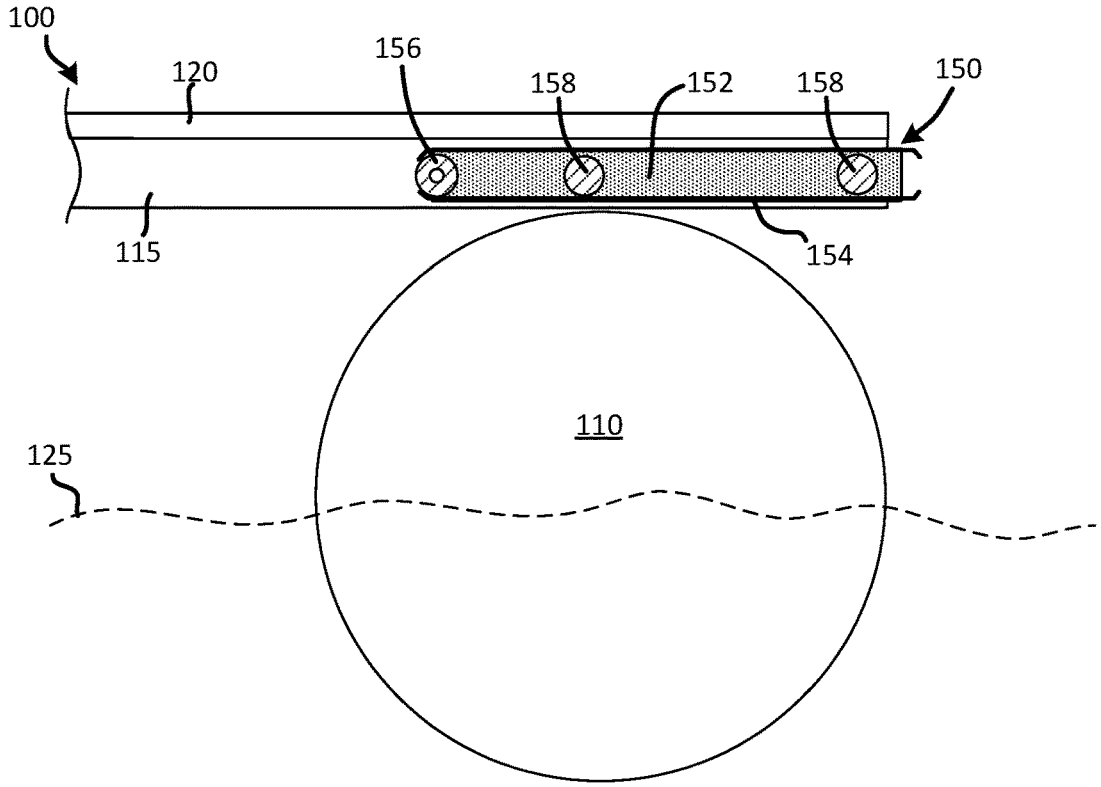
FIG. 2A is an end, cross-sectional view showing a support in a stowed position, in accordance with an embodiment of the present disclosure.
Figure 2B:
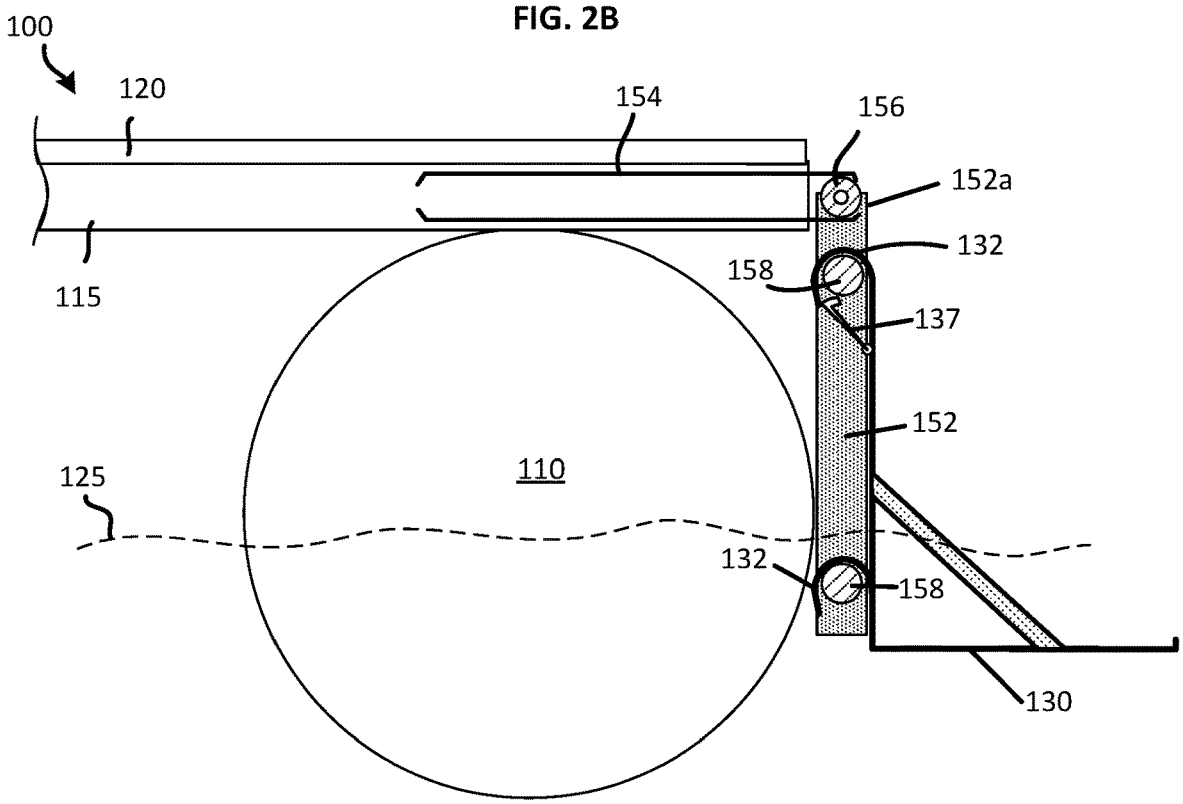
FIG. 2B is an end, cross-sectional view showing the support in a deployed position and with an accessory component attached to support crosspieces of the support, in accordance with an embodiment of the present disclosure.

FIGS. 2A and 2B illustrate a cross-sectional view of part of a pontoon boat 100 and components of an accessory support system 150 in a retracted position and a deployed position, respectively, in accordance with one embodiment. The accessory support system 150 includes a support 152 that includes a pair of spaced apart longitudinal members 159 connected by support crosspieces 158 extending between the longitudinal members 159. The support 152 is movably connected to guides 154 secured to adjacent crosspieces 115 below the deck 120, and therefore is operable between a stowed position and a deployed position. In one example, the guides 154 are roller tracks and the support 152 includes rollers 156 that engage the roller tracks. In other embodiments, the support 152 may slide or glide along the guides 154. In yet another embodiment, a pin on the support 152 engages a longitudinal slot in each guide 154 and allows the support 152 to slide between the retracted and stowed positions.

In the retracted position, such as shown in FIG. 2A, the support 152 can be stowed below the deck 120 between crosspieces 115. For example, after removing the accessory component 130 from the support 152, the support 152 is tilted up to a substantially horizontal position and then slid or rolled along the guides 154. To place the support 152 in the deployed position, such as shown in FIG. 2B, the support 152 can be pulled out from the retracted position, such as by sliding or rolling along the guides 154 and then folding the support 152 down against the pontoon 110.

In the deployed position, an accessory component 130 can be installed on the support 152. In the example shown in FIG. 2B, the accessory component 130 includes a platform useful to support a grill, cooler, person, or other item. The accessory component 130 includes hooks 132 or other attachment feature configured to engage the support 152. For example, hooks 132 hook over crosspieces 158 or other portion of the support 152 and enable hanging the accessory component 130 on the support 152. Optionally, a flexible tether or strap 160 (shown in FIG. 7) can be used to secure the accessory component 130 on the support 152 so that the action of the waves does not dislodge the accessory component 130 from the support 152. In this example, some or all of the hooks 132 include a spring-loaded gate 137 that is biased towards a blocking position with respect to the support crosspiece 158 to prevent the hook 132 from disengaging from the support 152. The user may depress the gate 137 to open access to the hook 132 for placing the hook 132 onto or removing the hook 132 from a support crosspiece 158.

Figure 3A:
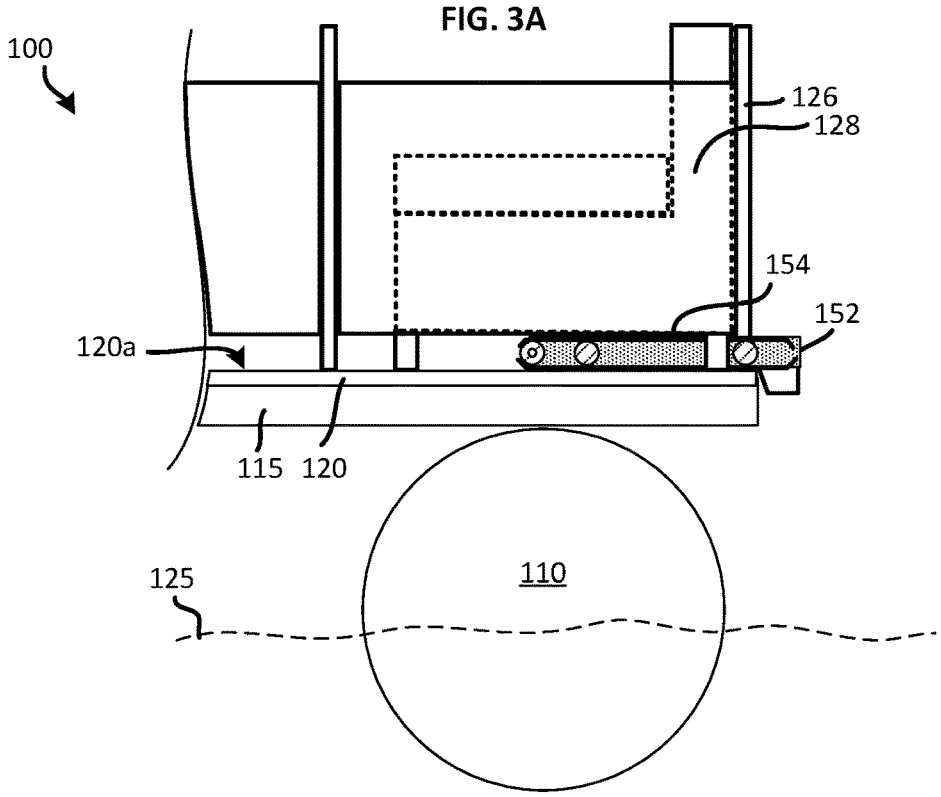
FIG. 3A is an end, cross-sectional view showing a support in a stowed position on top of the deck, in accordance with an embodiment of the present disclosure.
Figure 3B:
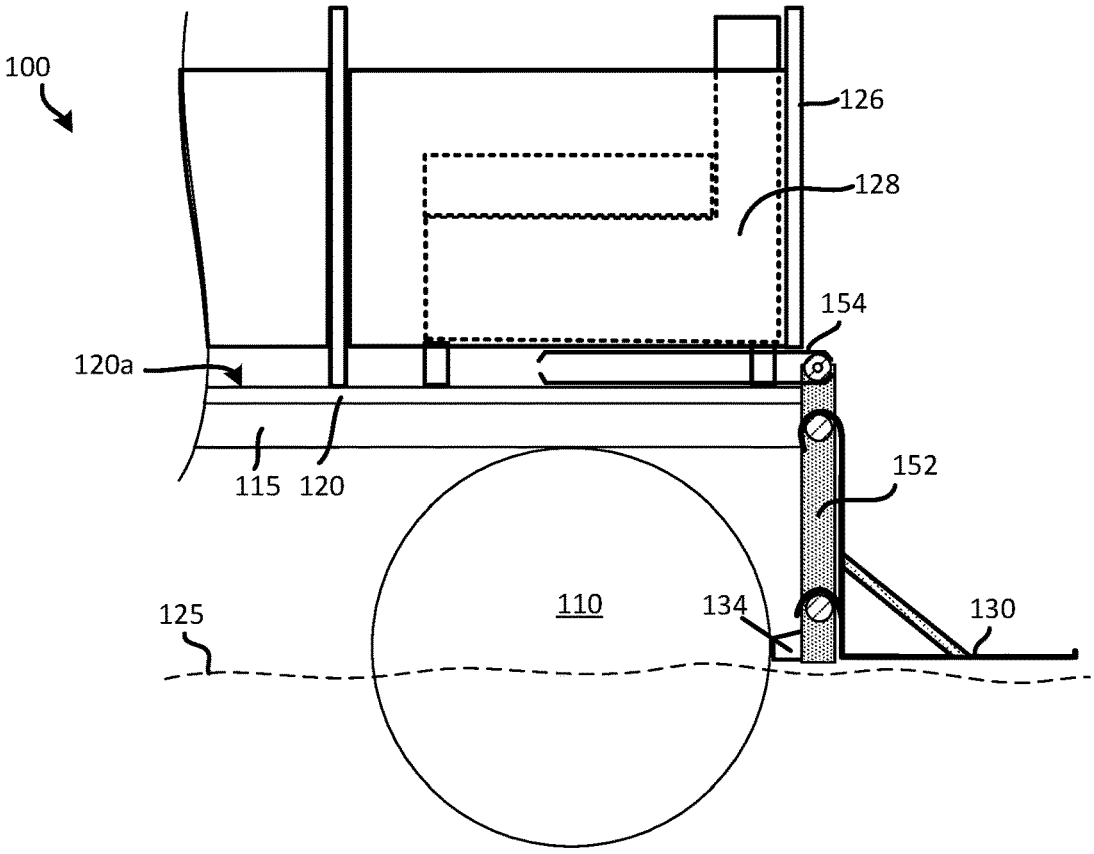
FIG. 3B is an end, cross-sectional view showing the support of FIG. 3A in a deployed position and with an accessory component attached to support crosspieces, in accordance with an embodiment of the present disclosure.

FIGS. 3A and 3B illustrate a cross-sectional view of part of a pontoon boat 100 and components of an accessory support system 150 in a retracted position and a deployed position, respectively, in accordance with another embodiment. The accessory support system 150 includes a support 152 that is slidably connected to guides 154 secured to a top surface 120*a* of the deck 120. As discussed above, the guides 154 can be roller tracks, channels for sliding movement, or other suitable structure. In this example, the guides 154 are positioned below a piece of furniture 128 on the deck 120, such as seating or a storage bin.

In the retracted or stowed position, such as shown in FIG. 3A, the support 152 can be stowed on the deck 120 below the furniture 128. For example, after removing the accessory component 130 from the support 152, the support 152 is tilted up to a substantially horizontal position and then slid or rolled along the guides 154 beneath railings 126 and furniture 128. To place the support 152 in the deployed position, such as shown in FIG. 3B, the support 152 can be pulled out from the retracted position, such as by sliding or rolling along the guides 154 and then folded down against the side of the pontoon 110. In some embodiments, the support 152 includes a bumper 134 that contacts the pontoon 110. The bumper 134 can be made of rubber, metal, wood, plastic, or any other suitable material. The support 152 is stabilized at least in part by the downward force applied by the weight of the accessory component 130, the rollers 156 captured by the guides 154, the support 152 contacting the deck 120 (or crosspieces 115 or skirt 129 along the deck and crosspieces 115), and the support 152 (e.g., bumper 134) making contact with the pontoon 110.

Figure 4:
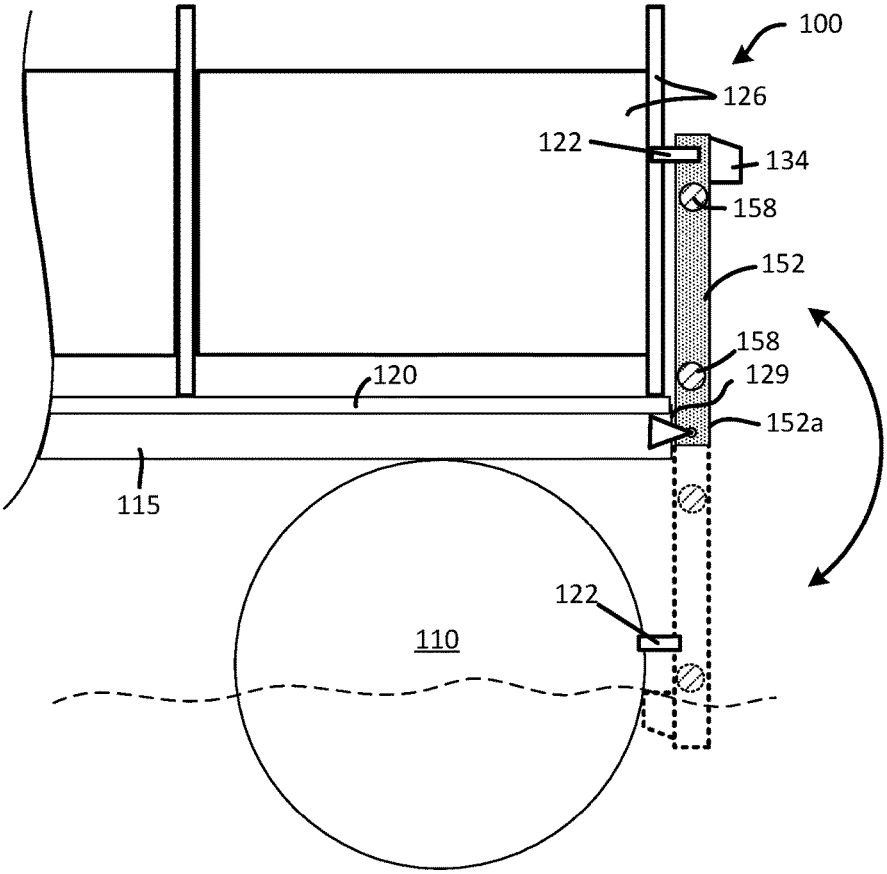
FIG. 4 is an end view showing a support attached to the structural crosspieces below the deck and movable between stowed and deployed positions, in accordance with another embodiment of the present disclosure.

FIG. 4 illustrates a cross-sectional view of part of a pontoon boat 100 and components of an accessory support system 150, in accordance with another embodiment. In this example, a support 152 is hingedly mounted to the deck 120 and/or finish materials (e.g., aluminum skirt 129) surrounding the crosspieces below the deck 120. For example, a first end 152*a* of the support 152 is connected to the boat 100 by a pivot bracket, hinge, or the like. In a retracted position, the support 152 can be folded to an upright position and retained against the railing 126. A retaining device 122, such as a flexible strap, rope, catch, hook, pin, or the like, can be used to retain the support 152 in the retracted position. After releasing the retaining device 122, the support 152 can be folded down to the deployed position. As discussed above, the support 152 is stabilized in the deployed position at least in part by the downward force applied by the weight of the accessory component 130, the first end 152*a* of the support being connected to the boat 100, part of the support 152 contacting the deck 120 (or crosspieces 115 or skirt 129 along the deck and crosspieces 115), and another portion of the support 152 (e.g., bumper 134) making contact with the pontoon 110. Optionally, a retaining device 122 can be used between the support 152 and the pontoon 110 or other structure of the boat 100. The retaining device 122 can be, for example, a clip, or strap connecting the support 152 to the pontoon 110.

Figure 5:
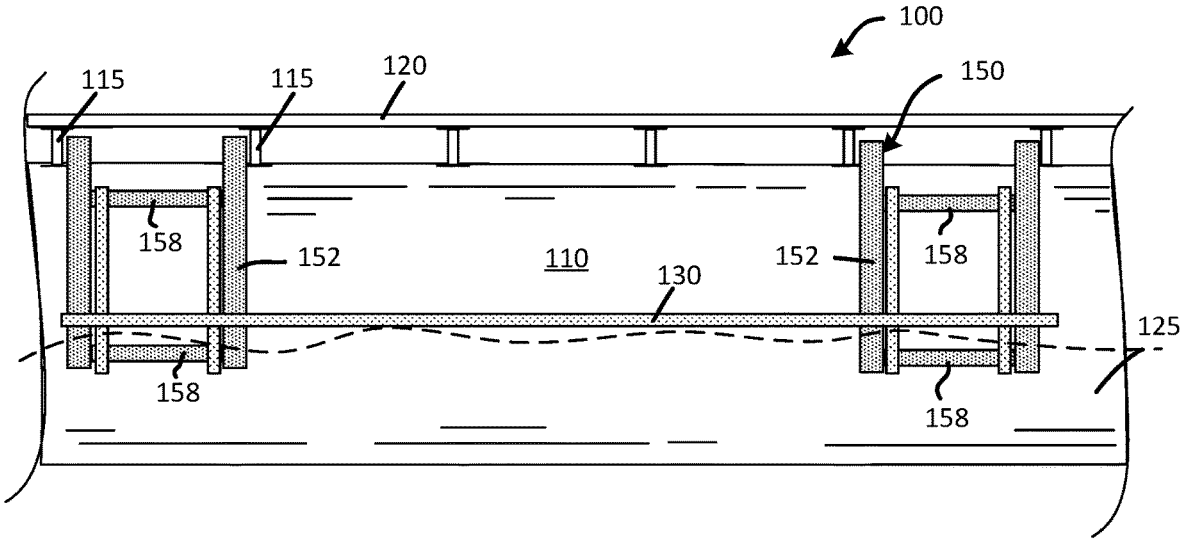
FIG. 5 is an elevational view showing an accessory system in use on a pontoon boat, in accordance with an embodiment of the present disclosure.

FIG. 5 illustrates a side view of part of a pontoon boat 100 with an accessory support system 150 in use, in accordance with an embodiment of the present disclosure. In this example, the accessory support system 150 includes two supports 152, each of which is attached to structural crosspieces 115 below the deck 120. Each support 152 includes longitudinal members 159 oriented vertically when deployed. The longitudinal members 159 are connected by horizontal support crosspieces 158. Note that one, two, or other number of supports 152 can be used depending on the accessory 166 to be placed on the accessory component(s) 130. For clarity of illustration, some standard components of the boat 100 are not shown, such as railings 126 or skirt 129 that surrounds the deck 120 and crosspieces 115.

In this example, both supports 152 are shown in a deployed position. Although the supports 152 are illustrated as being deployable from between adjacent crosspieces 115 beneath the deck 120, such as shown in FIGS. 2A-2B, the supports 152 alternately can attach to the top surface 120*a* of the deck 120 or to some other location on the boat 100 as deemed appropriate. The accessory component 130 is attached to both supports 152 by hooks (not visible, shown in FIG. 3B) attached to the support crosspieces 158. Note that the accessory 166 is a platform supported by the two accessory components 130. The accessory is positioned to be generally above water level 125. In accordance with some embodiments and depending on the desired use, the accessory 166 can alternately be positioned to be at below water level 125 by adjusting the supports 152 and/or the accessory component 130.

Figure 6:
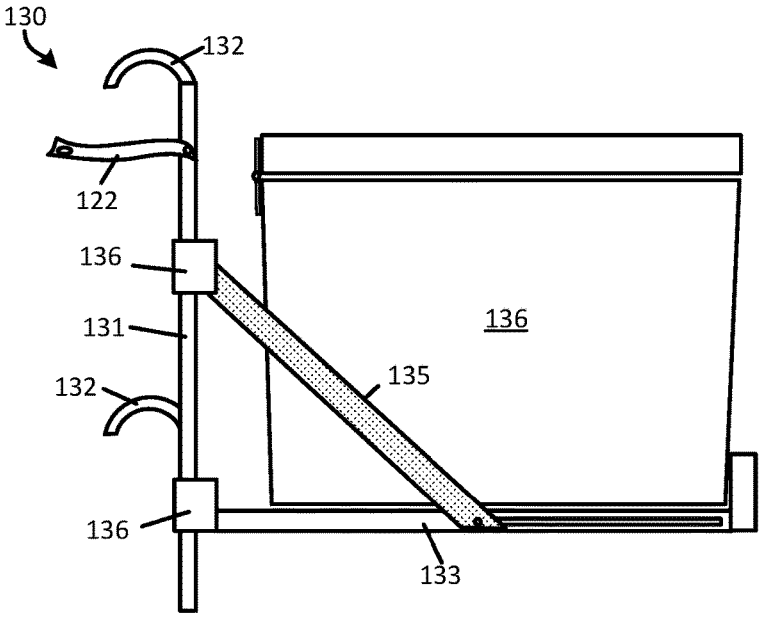
FIG. 6 illustrates a side view of an accessory on an accessory component, in accordance with an embodiment of the present disclosure.

FIG. 6 is a side view of an accessory component 130 that includes a shelf 133, in accordance with one embodiment of the present disclosure. The accessory component 130 includes a pair of vertical hangers 131 each having upper and lower hooks 132 sized and constructed to engage the support crosspieces 158 of a support 152 (e.g., shown in FIG. 5). A shelf 133 is connected to the hangers 131 and extends horizontally outward from the boat 100 when the accessory component 130 is installed on the support 152. An optional brace 135 extends diagonally between the shelf 133 and hangers 131. The brace 135 can be rigid or flexible, such as a bar, strap, or linkage. Optionally, one or more retaining devices 122 can be attached to the hanger(s) 131 to secure the accessory component 130 to the support 152. The shelf 133 and brace 135 each have an adjustable position along the hangers 131. For example, the hangers 131 include pipe clamps 136 or equivalent that can be loosened to move the pipe clamp 136 along the hanger 131 and then tightened to fix the position. Using this or other adjustment method, the vertical position of the shelf 133 can be adjusted as desired so that a cooler, grill, or other accessory 166 on the shelf 133 is positioned appropriately. For example, the vertical position of the shelf 133 can be adjusted so that the cooler is above water or partly in the water. Similarly, a pet walkway, chair, grill, radio, or other accessory 166 can be positioned as desired relative to the water and for optimal accessibility.

Figure 7:
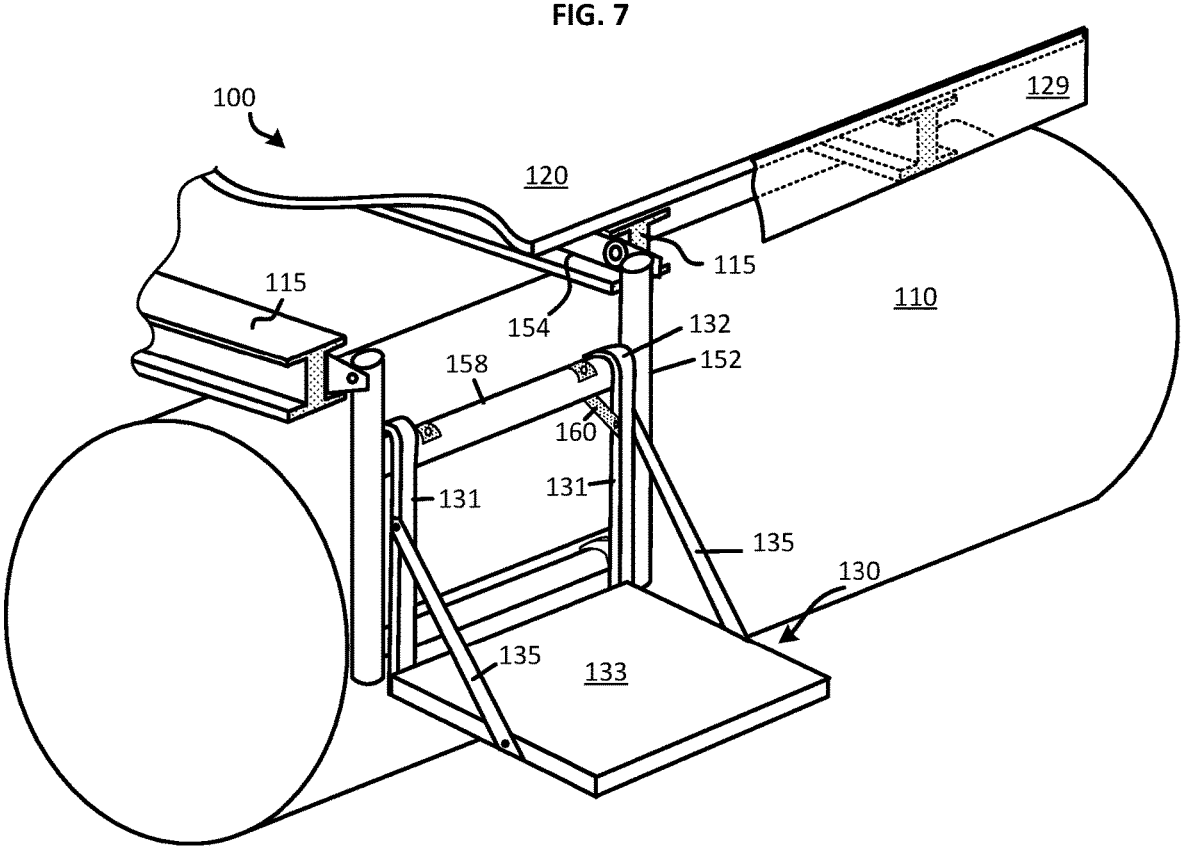
FIG. 7 illustrates a perspective view showing an accessory support system in use on a pontoon boat, where the first end of the support is connected to a track or slide that is secured to structural crosspieces of the boat, in accordance with an embodiment of the present disclosure.

FIG. 7 illustrates a perspective view of part of a pontoon boat 100 with an accessory support system 150 in use, in accordance with an embodiment of the present disclosure. The accessory support system 150 includes a support 152 slidably connected to guides 154 configured as roller tracks and secured to adjacent crosspieces 115 below the deck 120. An accessory component 130 is mounted on the support 152 using hangers 131 that each includes upper and lower hooks 132 that loop over the support crosspieces 158. In the example of FIG. 7, the accessory component 130 includes a shelf 133 useful to support a grill, cooler, or other item. Optionally, a flexible strap 160 is used to secure the accessory component 130 on the support 152 so that the action of the waves does not dislodge the accessory component 130 from the support 152. Optional braces 135 extend between hangers 131 and the shelf 133 to stabilize the shelf 133 in a horizontal position, such as when a heavy accessory 166 is placed on the shelf 133. Note that the support 152 is secured to the structural crosspieces 115 of the pontoon boat 100 and contacts the side of the pontoon 110.

Figure 8:
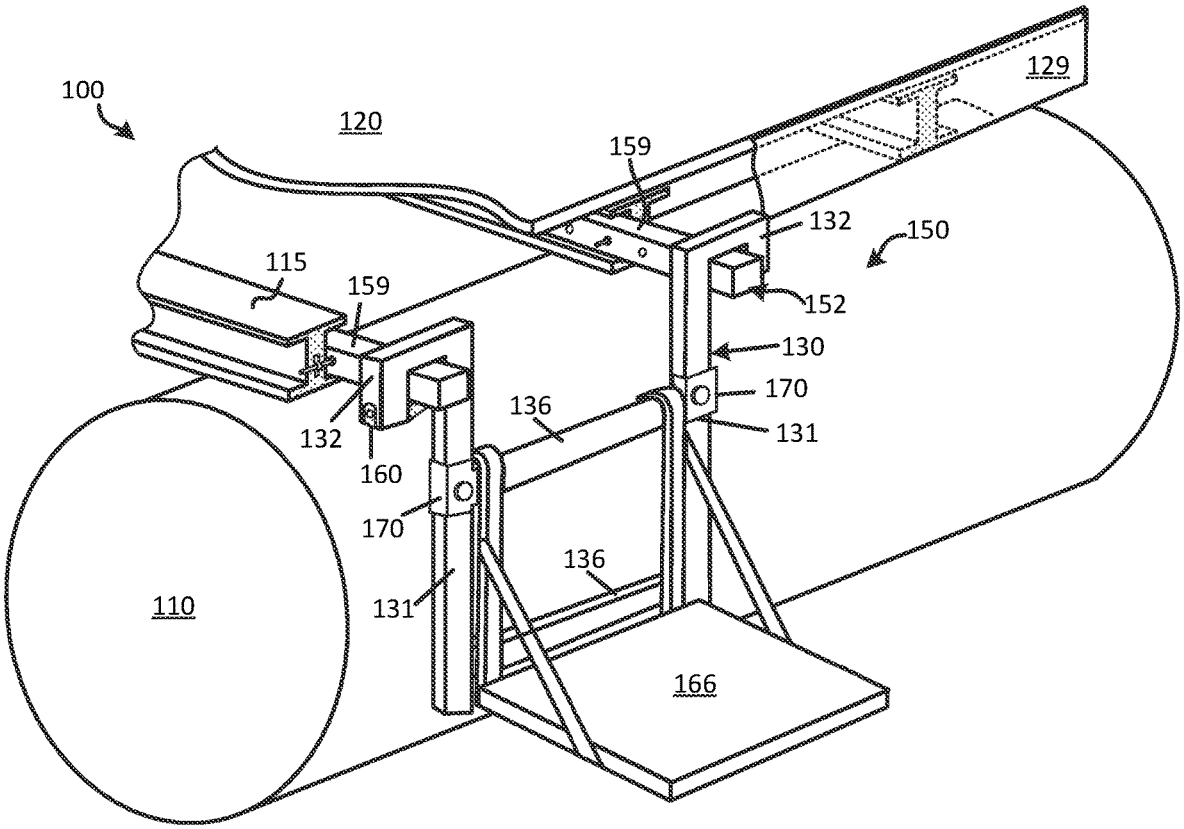
FIG. 8 illustrates a perspective view of an accessory support system in use on a pontoon boat, where the support extends laterally outward from the boat's structural crosspieces and the accessory component hooks over the support, in accordance with an embodiment of the present disclosure.

FIG. 8 illustrates a perspective view of part of a pontoon boat 100 with an accessory support system 150 in use, in accordance with an embodiment of the present disclosure. As shown in this example, the accessory support system 150 includes a support 152 slidably connected to structural crosspieces 115 below the deck 120. In the stowed position, the support 152 is oriented horizontally and is positioned below the deck 120. In other embodiments, the support 152 can be retained on the top surface of the deck 120, such as below furniture or storage bins on the deck 120.

The user may move the support 152 to the deployed position by sliding it out from the structural crosspieces 115. In the deployed position, the support 152 maintains the horizontal orientation and extends laterally beyond the structural crosspieces 115, such as shown in FIG. 8. In some embodiments, the support 152 has a single deployed position in which the support extends laterally beyond the boundary of the deck 120 by a predetermined distance, such as 4 inches, 6 inches, 8 inches, one foot, or other suitable amount. In other embodiments, the support 152 has a plurality of deployed positions each having a different amount of extension beyond the deck 120. In one such embodiment, the support defines through openings in the longitudinal members 159 so that a fastener or pin can be used to fix the position of the support 152 in one of the deployed positions. A support crosspiece 158 connects longitudinal members 159. Optionally, the support 152 includes one or more support crosspiece 158 (shown, e.g., in FIG. 7). For example, the support 152 includes a support crosspiece 158 connecting ends of the longitudinal members 159 and/or positioned at other locations along the longitudinal members as needed for structural integrity.

An accessory component 130 is mounted on the support 152 using hangers 131 that each includes hooks 132 that loop over the longitudinal members 159 of the support 152. In another embodiment, the support component 130 has an attachment feature configured as a horizontal bar that forms a T-shape with the hangers 131 and where the bar overlaps the longitudinal members 159 of the support. A support crosspiece 158 (not shown), cap, collar, strap or other device can be used to prevent the accessory component 130 from sliding off the ends of the longitudinal members 159.

The accessory component 130 has one or more crosspiece 136 some or all of which have an adjustable position along the hangers 131 via pipe clamps 170. A flexible strap 160 optionally can be used to secure the accessory component 130 to the support 152. An accessory 166 configured as a shelf or chair hangs from crosspiece 136 of the accessory component 130.

Figure 9:
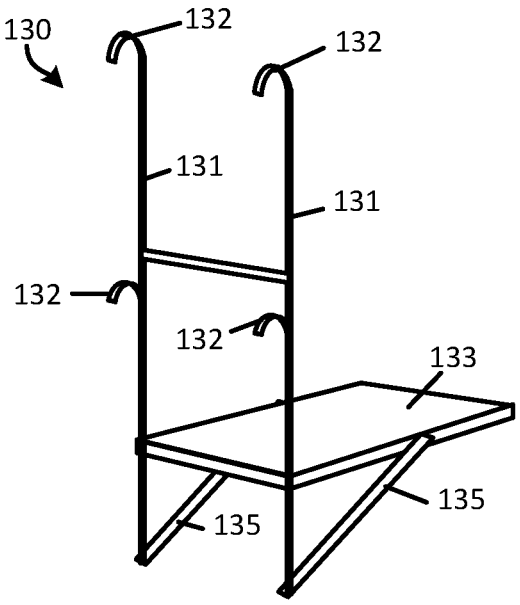
FIG. 9 is a rear perspective view of an accessory component that includes a shelf, in accordance with an embodiment of the present disclosure.

FIG. 9 illustrates a rear perspective view of an accessory component 130, in accordance with another embodiment of the present disclosure. The accessory component 130 includes a shelf 133 having an adjustable vertical position along the hangers 131. Optionally, the shelf 133 is reinforced by braces 135 made of a rigid material and that extend diagonally between the hangers 131 and the shelf 133. For example, each brace 135 is releasably connected to the side of the shelf 133 so that the brace 135 can be folded along the hanger 131 when the shelf 133 is not in use. In some embodiments, the shelf 133 can be hingedly attached at its rear end 133*a* to the hangers 131 so that the shelf 133 can be folded against the hangers 131 when not in use. Each hanger 131 is equipped with upper and lower hooks 132 each configured to engage a corresponding support crosspiece 158 (shown, e.g., in FIG. 7).

Figure 10:
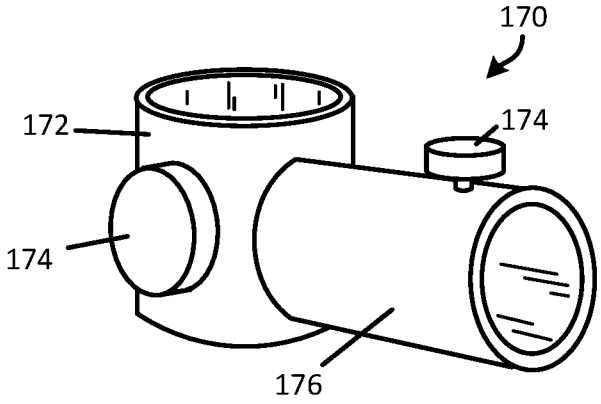
FIG. 10 illustrates a perspective view of a pipe clamp useful between horizontal and vertical tubes of a support or accessory component, in accordance with an embodiment of the present disclosure.

FIG. 10 illustrates a perspective view of a pipe clamp 170 that can be used to connect a support crosspiece 158 to the longitudinal member of the support 152. The pipe clamp 170 also enables adjustment of the support crosspiece 158 along the longitudinal member. In this example, the pipe clamp 170 is constructed with a first cylinder 172 to receive a vertical tube or pipe, such as a longitudinal member of the support 152. A fastener 174 can be tightened to create an interference fit between the first cylinder and the tube. A second cylinder 176 is connected perpendicularly to the first cylinder 172 and is constructed to receive a horizontal tube, such as support crosspiece 158. The support crosspiece 158 can be retained in the second cylinder 176 by a frictional fit, an adhesive, a fastener 174, or other suitable method. In use, the fastener 174 on the first cylinder 172 can be loosened so that the pipe clamp 170 can slide along the longitudinal member of the support 152, then tightened to fix the position.

Figure 11:
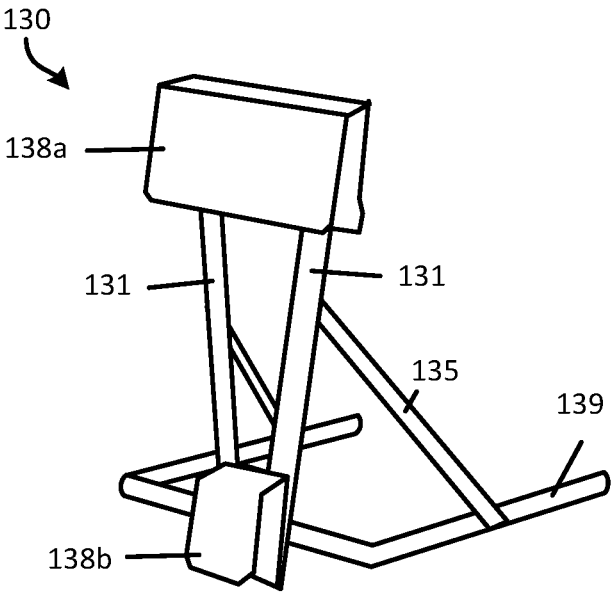
FIG. 11 illustrates an accessory component configured to support a grill, in accordance with an embodiment of the present disclosure. For example, the grill can simply sit on or be strapped to arms of the accessory component.

FIG. 11 illustrates a rear perspective view of an accessory component 130, in accordance with another embodiment of the present disclosure. In this embodiment, the accessory component 130 includes a support portion 162 configured as a frame for supporting, for example, a grill or cooler. The accessory component 130 includes an upper bracket 138*a* and a lower bracket 138*b*, each of which is configured to engage a horizontal support crosspiece 158 of the support 152. The upper and lower brackets 138 are connected by hangers 131 extending in a generally vertical direction. The support portion 162 is a frame having a U-shape that extends in a horizontal plane forward of the hangers 131 and is reinforced by braces 135, which can be made of a pliable material (e.g., nylon webbing), a rigid material (e.g., aluminum), or other suitable material for a particular application. The support portion 162 can be specially configured to engage and support a particular item, such as a portable grill having corresponding clips to engage arms of the support portion 162.

Figure 12:
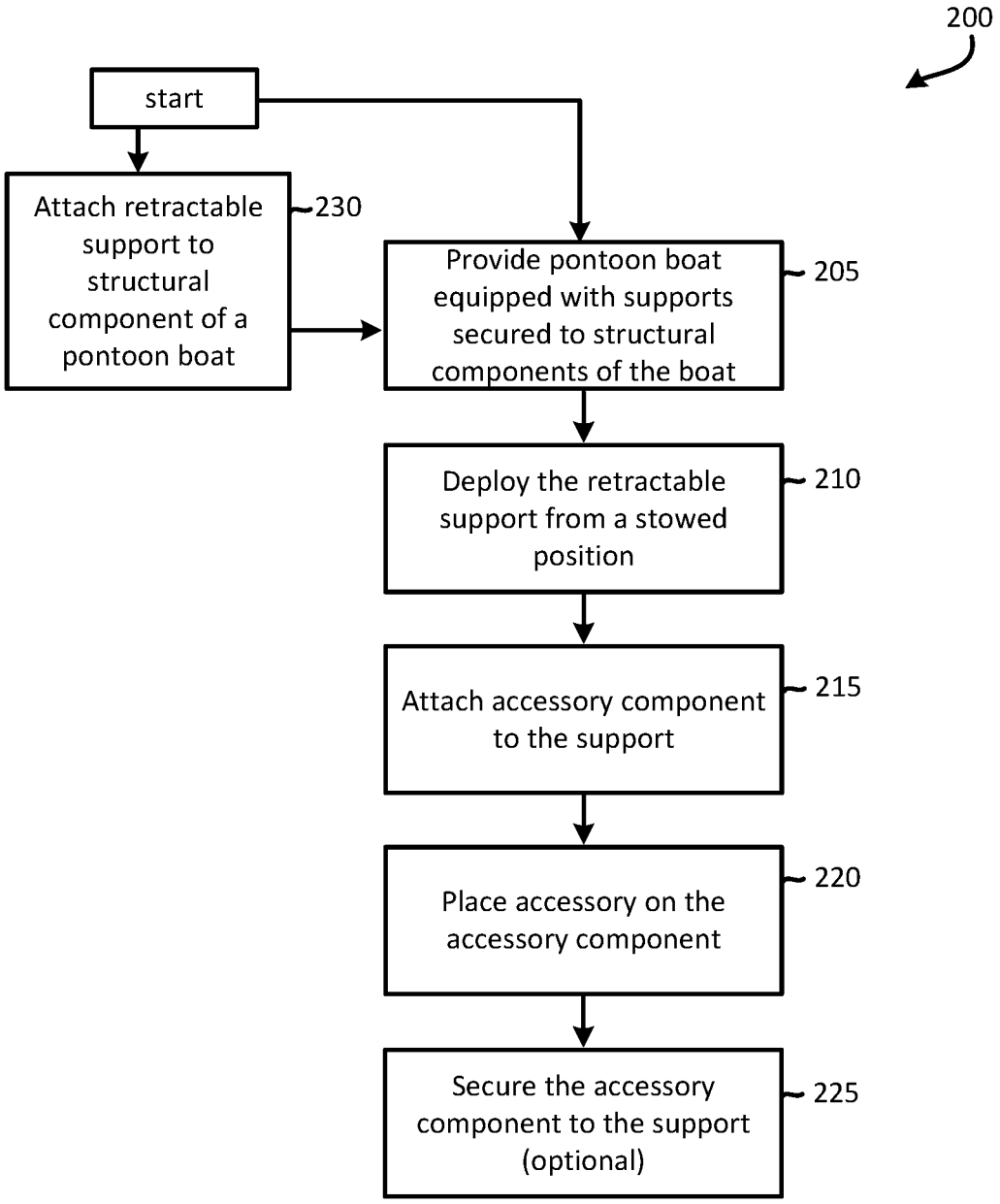
FIG. 12 illustrates a method of using an accessory support system, in accordance with an embodiment of the present disclosure.

FIG. 12 illustrates steps in a method 200 of using an accessory support system, in accordance with an embodiment of the present disclosure. Method 200 includes providing 205 a pontoon boat including pontoons, a deck over the pontoons, structural crosspieces between the deck and the pontoons, and an accessory support secured to a structural component of the pontoon boat. The accessory support includes one or more longitudinal members and one or more support crosspieces connected to and extending crosswise to the one or more longitudinal members, the accessory support is movable between a stowed position and a deployed position. In some embodiments, the support is oriented horizontally between adjacent structural crosspieces below the deck when in the stowed position. In another embodiment, the support is oriented horizontally on the top of the deck, such as beneath furniture, when in the stowed position. In yet another embodiment, the support is folded to an upright position extending upward along a railing of the pontoon boot when in the stowed position.

Method 200 continues with deploying 210 the support from a stowed position to a deployed position. In some embodiments, the support is oriented horizontally above or below the deck in the stowed position and is oriented vertically with a first end of the support connected to the structural component and a second end of the accessory support vertically below the first end and the accessory support extending downward along a side of one of the pontoons in the deployed position. In another embodiment, the support simply slides or glides horizontally from a stowed position below (or above) the deck to a deployed position in which the support extends laterally beyond the frame of the boat, such as shown in FIG. 8. In one embodiment, deploying 210 the support includes pulling the support horizontally from a stowed position beneath or on top of the deck, then folding the support down to extend vertically along the side of the pontoon. In another embodiment, deploying 210 the support includes releasing a catch or other retaining device, then folding the support about 180° from the stowed position to the deployed position against the side of the pontoon.

Method 200 continues with attaching an accessory component to the support. In one example, the accessory component includes hooks that are looped over part of the support, allowing the accessory component to hang from the support. In some embodiments, the accessory component comprises a platform or arms generally extending outward in a horizontal plane when the accessory component is attached to the support.

Method 200 continues with placing 220 an accessory on the accessory component. For example, the accessory is a grill, cooler, chair, radio, or other accessory. In some embodiments, placing 220 the accessory includes positioning the accessory to be at or above a center of the side of the pontoon.

Optionally, method 200 includes securing 225 the accessory component to the support. Securing may be performed by use of a strap, tether, chain, cord, latch, catch, fastener, pin, or bracket to obstruct or otherwise impede the accessory component disengaging from the support. For example, hooks on the accessory component include a spring-loaded gate that can be depressed to open access for the support crosspiece to enter the hook. In another example, a flexible tether or strap is secured between the accessory component and the support, such as using a cleat, a pin, or a catch.

Optionally, method 200 includes securing 230 the support to a structural component of the pontoon boat. The structural component can be structural crosspieces supporting the deck or the deck itself, for example. In one embodiment, securing the support includes attaching a track to the structural component, where the first end of the support is connected to the track via a roller, slider, or the like.

Note that the processes in method 200 are shown in a particular order for ease of description. However, one or more of the processes may be performed in a different order or may not be performed at all (and thus be optional), in accordance with some embodiments. Numerous variations on method 200 and the techniques described herein will be apparent in light of this disclosure. Additionally, some or all steps of method 200 can be performed in a reverse order to discontinue use of the accessory support system, in accordance with some embodiments.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. An accessory support system comprising:

a support comprising longitudinal members and at least one support crosspiece extending between and connecting the longitudinal members, the support configured to be attached to a structural component of a pontoon boat and movable between a stowed position and a deployed position; and an accessory component comprising one or more hangers;

at least one crosspiece connected to the one or more hangers; and an attachment feature on the one or more hangers, the attachment feature constructed to engage the support and maintain the accessory component on the support when the support is in the deployed position, wherein the accessory component is configured to be removably attached to the support.

2. The system of claim 1, further comprising a track movably coupled to a first end of the support, the track configured to be secured to a deck or to a structural crosspiece of a pontoon boat, wherein the first end of the support is movable along the track.

3. The system of claim 2, wherein in the deployed position, the support is configured to hang vertically down along a side of a pontoon of the pontoon boat.

4. The system of claim 1, wherein the structural component of the pontoon boat is a structural crosspiece of a boat deck.

5. The system of claim 1, further comprising a retaining device on the accessory component, the retaining device configured to be operable between a released position and a retaining position, wherein in the retaining position the retaining device secures the accessory component to the support.

6. The system of claim 5, wherein the retaining device is selected from a spring-loaded gate on the hook, a strap, a cord, a chain, a catch, and a spring plunger.

7. The system of claim 1, wherein the at least one support crosspiece has an adjustable position along the longitudinal members.

8. The system of claim 1, further comprising a support portion connected to the one or more hangers and extending transversely outward therefrom, the support portion comprising a seat, a platform, or a frame.

9. The system of claim 8, further comprising a portable grill, wherein the support portion is the frame and the frame is constructed to engage and support the portable grill.

10. The system of claim 8, wherein the support portion of the accessory is configured to have a vertical position at or above a center of a pontoon of the pontoon boat when the accessory is installed on the support.

11. A method comprising:

providing a pontoon boat including pontoons, a deck over the pontoons, structural crosspieces between the deck and the pontoons, and an accessory support secured to a structural component of the pontoon boat, wherein the accessory support includes one or more longitudinal members and one or more support crosspieces extending between and connecting the one or more longitudinal members, the accessory support movable between a stowed position and a deployed position;

deploying the support from a stowed position in which the support is oriented horizontally above or below the deck, to a deployed position; and attaching an accessory component to the accessory support, making a connection between the accessory and the pontoon boat so that the accessory and the pontoon boat move together on water.

12. The method of claim 11, wherein the support is oriented vertically with a first end of the support connected to the structural component and a second end of the accessory support vertically below the first end and the accessory support extending downward along a side of one of the pontoons when the support is in the deployed position.

13. The method of claim 12, wherein in the stowed position the support is oriented vertically against a rail of the pontoon boat with the second end of the support above the first end of the support.

14. The method of claim 11, wherein in the deployed position the support extends horizontally outward beyond a boundary of the deck.

15. The method of claim 11, wherein in the stowed position the accessory support is oriented horizontally along a top of the deck.

16. The method of claim 11, wherein the accessory component comprises a platform generally extending in a horizontal plane when the accessory component is attached to the accessory support, the method further comprising placing an accessory on the accessory component, the accessory selected from a portable grill, a cooler, and a seat, wherein at least part of the accessory has a vertical position at or above a center of a side of one of the pontoons.

17. The method of claim 11, further comprising securing a track to a top surface of the deck, wherein a first end of the support is connected to and movable along the track.

18. The method of claim 11, further comprising securing a track to adjacent structural crosspieces of the pontoon boat, wherein a first end of the support is connected to and movable along the track below the deck.

19. The method of claim 11, wherein deploying the accessory support includes folding the accessory support downward against the pontoon.

20. The method of claim 11 further comprising locking the accessory component to the accessory support using one of a spring-loaded gate, a tether, a fastener, a catch, or a bracket.

* * * * *